US005375981A

United States Patent [19]

Fujii et al.

[11] Patent Number: 5,375,981

[45] Date of Patent: Dec. 27, 1994

[54] REFRIGERANT GAS GUIDING MECHANISM IN PISTON TYPE COMPRESSOR

[75] Inventors: Toshiro Fujii; Hiromi Kitayama; Hitoshi Inukai; Koichi Ito, all of Kariya, Japan

[73] Assignee: Kabushiki Kaisha Toyoda Jidoshokki Seisakusho, Kariya, Japan

[21] Appl. No.: 195,366

[22] Filed: Feb. 10, 1994

Related U.S. Application Data

[63] Continuation-in-part of Ser. No. 154,279, Nov. 18, 1993, Pat. No. 5,370,506, which is a continuation-in-part of Ser. No. 103,888, Aug. 6, 1993, abandoned, and a continuation-in-part of Ser. No. 102,588, Aug. 5, 1993, and a continuation-in-part of Ser. No. 101,927, Aug. 4, 1993, Pat. No. 5,368,540, and a continuation-in-part of Ser. No. 101,188, Aug. 3, 1993.

[30] Foreign Application Priority Data

Feb. 10, 1993 [JP] Japan ..... 5-022930

[51] Int. Cl.[5] ..... F04B 1/12

[52] U.S. Cl. ..... 417/269; 91/484; 91/502

[58] Field of Search ..... 417/269; 184/6.17; 91/480, 484, 499, 502

[56] References Cited

U.S. PATENT DOCUMENTS

| | | | |
|---|---|---|---|
| 1,364,508 | 1/1921 | Moody . | |
| 1,925,378 | 9/1933 | Ferris et al. | 91/484 X |
| 4,007,663 | 2/1977 | Nagatomo et al. | 91/499 |
| 4,475,443 | 10/1984 | Forster | 91/499 |
| 5,076,764 | 12/1991 | Kawai et al. | 417/269 |
| 5,207,078 | 5/1993 | Kimura et al. | 417/269 |
| 5,286,173 | 2/1994 | Takenaka et al. | 417/269 |

FOREIGN PATENT DOCUMENTS

| | | |
|---|---|---|
| 0923985 | 2/1955 | Germany . |
| 0258446 | 7/1988 | Germany . |
| 0269881 | 7/1989 | Germany . |
| 0103728 | 3/1924 | Switzerland . |
| 0116613 | 9/1925 | Switzerland . |

*Primary Examiner*—Richard A. Bertsch
*Assistant Examiner*—Michael I. Kocharov
*Attorney, Agent, or Firm*—Brooks Haidt Haffner & Delahunty

[57] ABSTRACT

A refrigerant gas suction valve mechanism for a reciprocating piston type compressor is disclosed. The mechanism has a drive shaft rotatably disposed in a gas receiving chamber where uncompressed gas is introduced, Double- headed pistons provided in cylinder bores compress the gas when the pistons move from the bottom dead center to the top dead center. A suction port selectively permits and blocks communication between the suction passage and the compression chambers. A resilient member holds a rotary valve in contact with an inner wall of a recessed chamber with predetermined force. The suction port is maintained at a predetermined distance from a point where the pistons reach the top dead center so that the suction port is closed by the pistons before the pistons reach the top dead center.

10 Claims, 4 Drawing Sheets

REFRIGERANT GAS GUIDING MECHANISM IN PISTON TYPE COMPRESSOR

This is a continuation-in-part of co-pending U.S. application Ser. No. 08/154,279 filed Nov. 18, 1993, now U.S. Pat. No. 5,370,506 which is a continuation-in-part of U.S. application Sr. No. 08/103,888 filed on Aug. 6, 1993, now abandoned, and a continuation-in-part of U.S. application Ser. No. 08/102,588 pending filed Aug. 5, 1993, and a continuation-in-part of U.S. application Ser. No. 08/101,927 U.S. Pat. No. 5,368,540 filed on Aug. 4, 1993, and a continuation-in-part of U.S. application Ser. No. 08/101,188 filed on Aug. 3, 1993, all of which are incorporated herein by reference.

BACKGROUND OF THE INVENTION

1. Field of the Invention

The present invention relates to a refrigerant gas suction structure in a piston type compressor, which has pistons retained in a plurality of cylinder bores arranged around a drive shaft so that the pistons reciprocate with the rotation of the drive shaft, and which is suitable for an air conditioner in a vehicle.

2. Description of the Related Art

In a conventional piston type compressor (see Japanese Unexamined Patent Publication (Kokai) No. 3-92587, for example), suction ports respectively arranged between compression chambers and suction chambers are opened and closed by flapper type valves. The refrigerant gas in each suction chamber is drawn into the associated compression chamber through the associated flapper type valve which is forced open during the suction stroke of the piston moving from the top dead center to the bottom dead center. In the discharge stroke where the pistons move from the bottom dead center to the top dead center, the flapper type valves are closed, closing the suction ports. The refrigerant gas in the compression chamber is discharged through the discharge port, pushing the discharge valve, into the associated discharge chamber.

The opening and closing of the flapper type valves are caused by the pressure differences between the compression chambers and the suction chambers. When the pressure in the suction chambers is higher than that in the compression chambers, which occurs during the suction stroke of the pistons moving from the top dead center to the bottom dead center, the flapper type valves are bent or elastically deformed to open the suction ports.

The deformation of the flapper type valves acts as an elastic resistance against the movement of the respective suction valves. Accordingly, the flapper type valves will not open unless the pressure in the suction chambers becomes higher by some degree than that in the compression chambers. That is, the opening of the flapper type valves is delayed. A lubricating oil is suspended in the refrigerant gas in order to lubricate the internal components of the compressor. Thus, the lubricating oil is carried with the refrigerant gas to the necessary internal portions of the compressor. The lubricating oil can enter wherever the refrigerant gas flows, and will stick on the contact faces between the suction ports and the flapper type valves closing the suction ports. The sticking lubricating oil increases the contact force between the contact faces and the flapper type valves, further delaying the beginning of the deformation of the flapper type valves. This deformation delay reduces the flow rate of the refrigerant gas from the suction chambers into the compression chambers, or reduces the volumetrio efficiency. Further, even when the flapper type valves are opened, the elastic resistance of the flapper type valves also acts as a resistance against the suction of the refrigerant gas, thus reducing the flow rate of the refrigerant gas.

SUMMARY OF THE INVENTION

It is therefore a primary object of the present invention to provide a refrigerant gas suction structure in a piston type compressor, which is designed to reduce the chance of damaging the internal mechanism, thereby ensuring a longer service life. In this respect, this invention aims at providing a refrigerant gas suction structure in a piston type compressor, which ensures smooth sliding between the outer surface of a rotary valve and the inner wall of a receiving chamber that accommodates this rotary valve.

It is another object of this invention to provide a refrigerant gas guiding mechanism in a piston type compressor, which will contribute to reducing the general size of the compressor while improving the volumetric efficiency.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

One embodiment of the present invention as applied to a swash plate type double-headed piston type compressor will now be described referring to the accompanying drawings.

Figure 2:
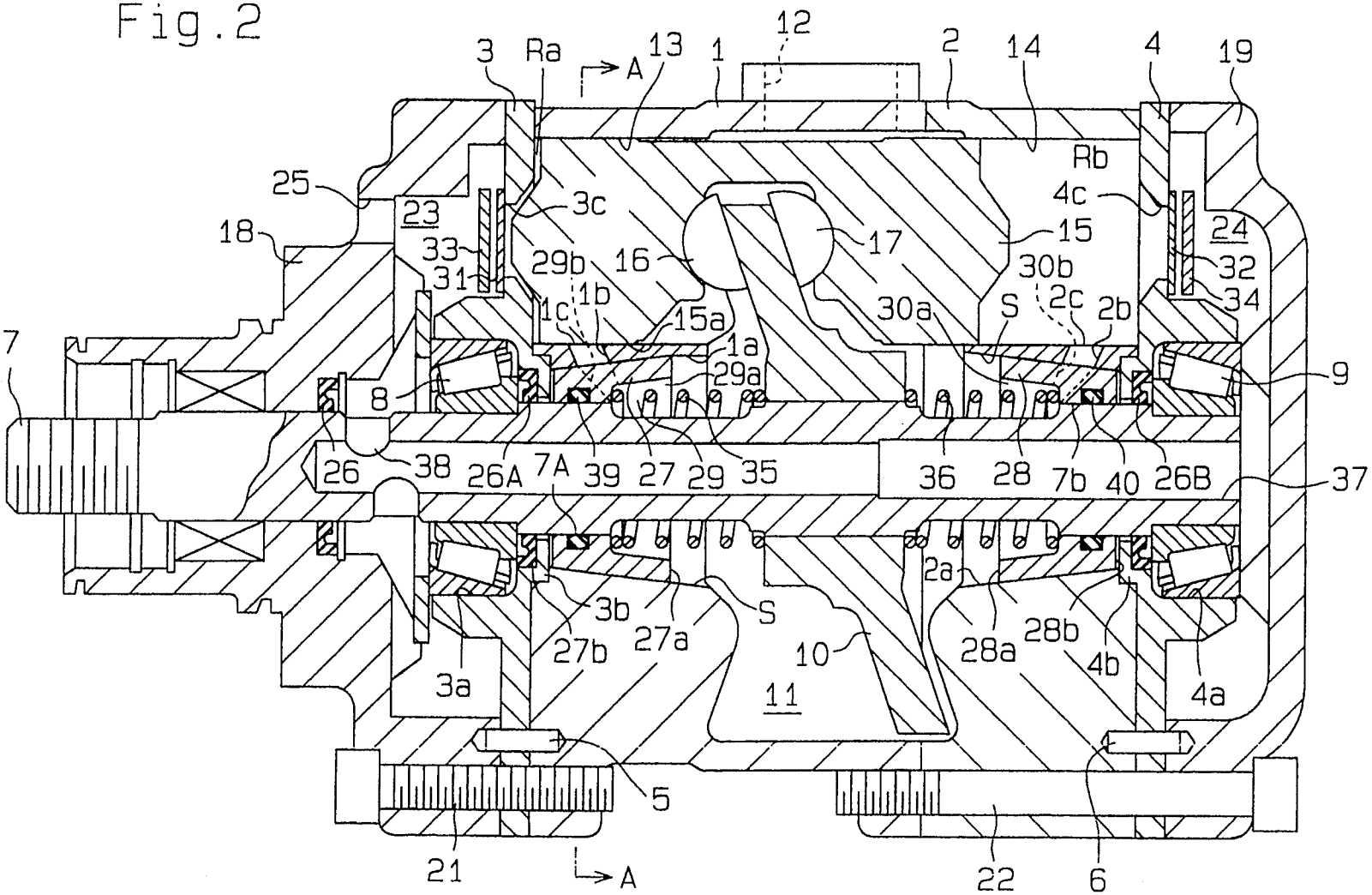
FIG. 2 is a side cross-sectional view showing, in enlargement, the essential portions of the compressor in FIG. 1.

Valve receiving chambers 1*a* and 2*a* are respectively provided at the center portions of a pair of front and rear cylinder blocks 1 and 2 connected as shown in FIG. 2. Valve plates 3 and 4 are attached to both ends of the cylinder blocks 1 and 2. Bearing receipt bores 3*a* and 4*a* are bored through the valve plates 3 and 4. Annular positioning projections 3*b* and 4*b* are protrusively provided at the valve plates 3 and 4, and are fitted in the valve receiving chambers 1*a* and 2*a*, respectively. The rotations of the valve plates 3 and 4 with respect to the cylinder blocks 1 and 2 are inhibited by pins 5 and 6, respectively.

A drive shaft 7 is rotatably supported in the bearing receipt bores 3*a* and 4*a* of the valve plates 3 and 4 via tapered roller bearings 8 and 9, with a swash plate 10 securely fitted over the drive shaft 7. The tapered roller bearings 8 and 9 receive the thrust force and radial force that act on the drive shaft 7.

Gas inlet ports 12 are formed in the cylinder blocks 1 and 2, which form a crank chamber 11, and an external refrigerant gas inlet pipe (not shown) is connected to the gas inlet ports 12.

Figure 1:
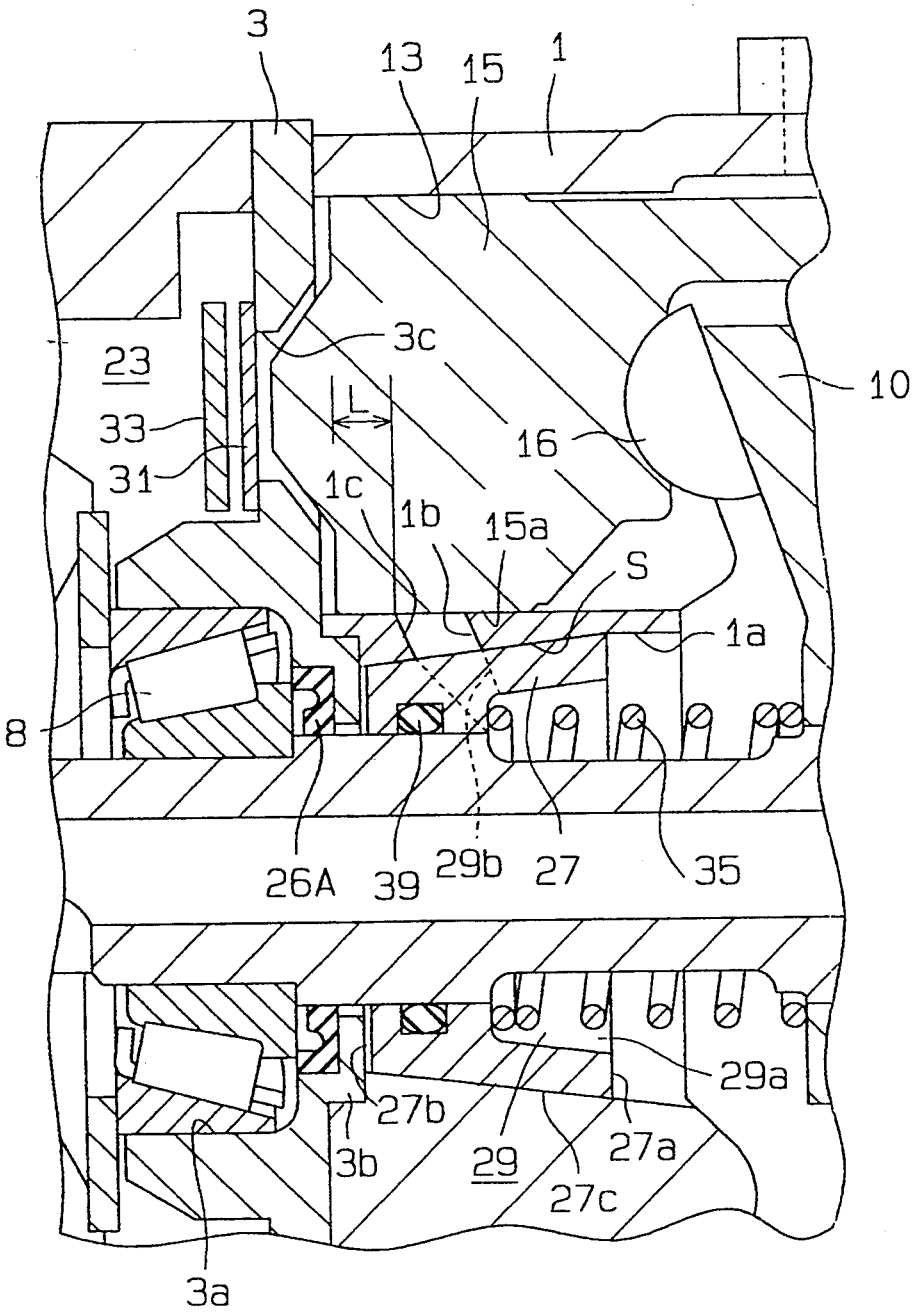
FIG. 1 is a side cross-sectional view illustrating the overall compressor embodying this invention.
Figure 3:
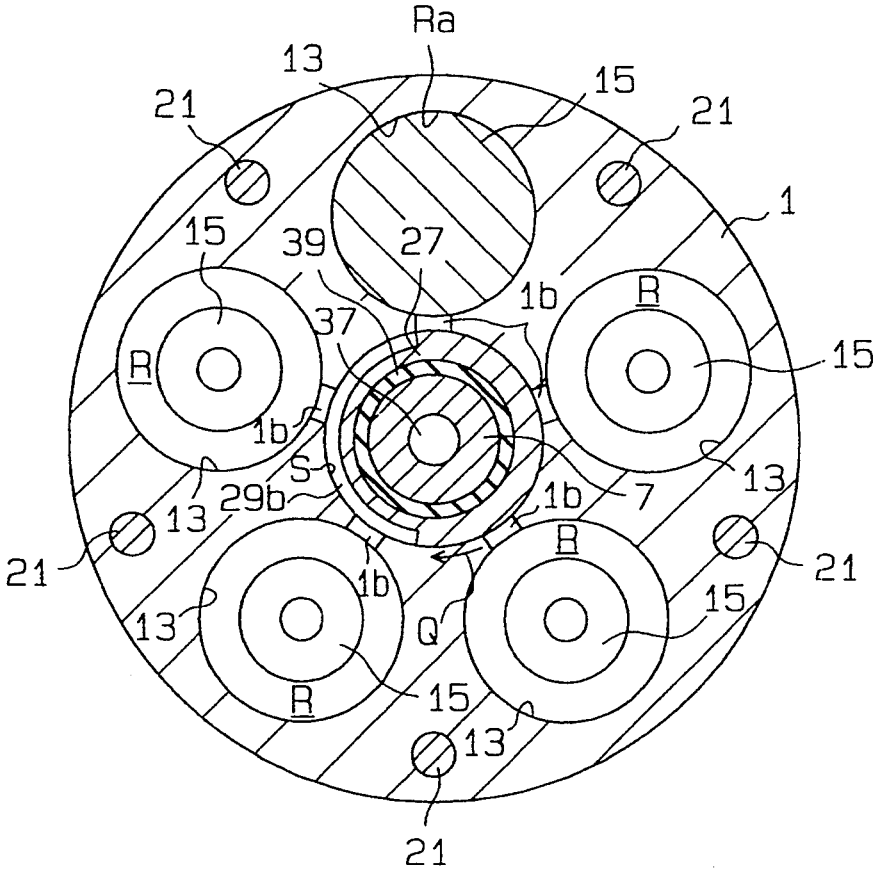
FIG. 3 is a cross-sectional view of the compressor in FIG. 1.

As shown in FIGS. 2 and 3, a plurality of cylinder bores 13 and 14 are formed equiangularly in the cylinder blocks 1 and 2 around the drive shaft 7. As shown in FIGS. 1 and 2, double-headed pistons 15 are retained in a reciprocal manner in the cylinder bores 13 and 14 so arranged to form a plurality of pairs (five pairs in this embodiment). Hemispherical shoes 16 and 17 are provided between the double-headed piston 15 and the front and rear ends of the swash plate 10. As the swash plate 10 rotates, therefore, the double-headed piston 15 reciprocates in the cylinder bores 13 and 14.

As shown in FIG. 2, front and rear housings 18 and 19 are attached to the end faces of the cylinder blocks 1 and 2. The valve plate 3 and the front housing 18 are secured to the cylinder block 1 by bolts 21. The cylinder block 1, cylinder block 2, valve plate 4 and rear housing 19 are secured together by bolts 22.

Discharge chambers 23 and 24 are formed inside both housings 18 and 19. Compression chambers Ra and Rb, which are defined in the respective pairs of cylinder bores 13 and 14 continuously maintain suction and compression forces produced by the double-headed piston 15. Chambers Ra and Rb communicate with their respective discharge chambers 23 and 24 via discharge ports 3c and 4c provided in the valve plates 3 and 4. These discharge ports 3c and 4c are opened and closed by flapper type discharge valves 31 and 32. the angles of the discharge valves 31 and 32 are defined by their respective retainers 33 and 34. The discharge valves 31 and 32 and the retainers 33 and 34 are fixed by bolts (not shown) to the valve plates 3 and 4. The discharge chamber 23 communicates with an external refrigerant gas outlet pipe (not shown) via an outlet port 25.

A lip seal 26 prevents the refrigerant gas in the discharge chamber 23 from leaking outside the compressor along the drive shaft 7. Lip seals 26A and 26B retained in the annular positioning projections 3b and 4b prevent the refrigerant gas in the discharge chambers 23 and 24 from leaking toward the crank chamber 11 along the outer surface of the drive shaft 7.

Figure 4:
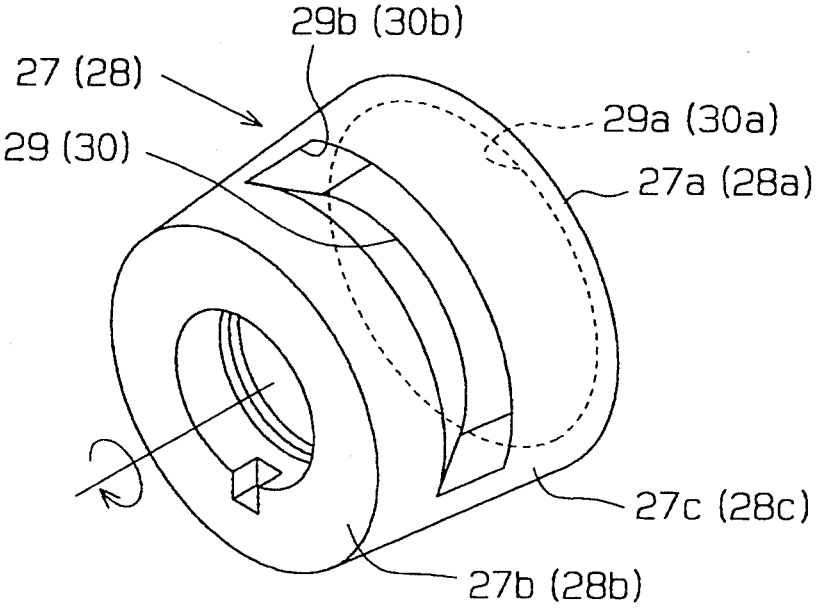
FIG. 4 is a perspective view of a rotary valve.

As shown in FIGS. 2 and 4, rotary valves 27 and 28 are supported on the drive shaft 7 at the annular raised portions 7a and 7b thereof so as to be slidable in the thrust direction. Seal rings 39 and 40 are arranged between the rotary valves 27 and 28 and the dirve shaft 7. The rotary valves 27 and 28 are retained in the valve receiving chambers 1a and 2a to be rotatable together with the drive shaft 7 in a direction Q in FIG. 3.

As further shown in FIGS. 2 and 4, the inner walls S of the valve receiving chambers 1a and 2a have tapered shapes and become larger in diameter toward the center of the cylinder blocks 1 and 2 from the ends thereof. In association with the inner walls of the valve receiving chambers 1a and 2a, the rotary valves 27 and 28 have tapered outer surfaces 27c and 28c, respectively, which are closely fitted in the valve receiving chambers 1a and 2a. More specifically, a large-diameter end portion 27a of the rotary valve 27 is directed toward the crank chamber 11, and a small-diameter end portion 27b thereof is directed toward the discharge chamber 23. Likewise, a large-diameter end portion 28a of the rotary valve 28 is directed toward the crank chamber 11, and a small-diameter end portion 28b thereof is directed toward the discharge chamber 24.

As shown in FIGS. 2 and 4, the rotary valves 27 and 28 are provided inside with suction passages 29 and 30, respectively, which have inlets 29a and 30a opening toward the large-diameter end portions 27a and 28a, and outlets 29b and 30b opening to the outer surfaces 27c and 28c.

As shown in FIGS. 2 and 3, the inner wall S of the receiving chamber 1a, which receives the rotary valve 27, is provided with suction ports 1b, which are equal in number to the cylinder bores 13. The suction ports 1b are arranged equiangularly so that each suction port 1b communicates with the associated cylinder bore 13 and is located in the peripheral portion of an outlet 29b of the associated suction passage 29.

Likewise, the inner wall S of the receiving chamber 2a, which receives the rotary valve 28, is provided with suction ports 2b, which are equal in number to the cylinder bores 14. The suction ports 2b are arranged equiangularly so that each suction port 2b, located in the peripheral portion of an outlet 30b of the associated suction passage 30, communicates with the associated cylinder bore 14.

As shown in FIGS. 1 and 2, outlets 1c and 2c of the suction ports 1b and 2b are so located as to be closed by an inner wall 15a of the piston 15 before the top dead center of the piston 15 by a given distance L.

Suction pressure acts in the crank chamber 11, and either the suction pressure or the discharge pressure acts on the compression chambers Ra and Rb, thereby changing the gas volumes in those chambers. The high-pressure refrigerant gas in the compression chambers Ra and Rb reaches the outer surface 27c of the rotary valve 27 via the suction ports 1b and 2b, and leaks inside the crank chamber 11 through the clearnace between this outer surface 27c and the inner wall S of the valve receiving chamber 1a. This leak will be prevented by urging the rotary valves 27 and 28 toward the small-diameter end portions 27b and 28b from the large-diameter end portions 27a and 28a respectively, by means of resilient members or springs 35 and 36. More specifically, the outer surfaces 27c and 28c of the rotary valves 27 and 28 are pressed against the inner walls S of the valve receiving chambers 1a and 2a, so that the rotary valves 27 and 28 rotate while sliding on the inner walls S of the valve receiving chambers 1a and 2a. Therefore, the refrigerant gas discharged from the compression chambers Ra and Rb will not leak into the crank chamber 11 through the clearance between the outer surfaces 27c and 28c and the respective inner walls S.

The tapered shapes of the outer surfaces 27c and 28c of the rotary valves 27 and 28 prevent the leakage of the discharge refrigerant gas, improving the volumetric efficiency. In addition, such a design allows for the easy fitting of the rotary valves 27 and 28 into their respective valve receiving chambers 1a and 2a.

The tapered shapes of the outer surfaces 27c and 28c of the rotary valves 27 and 28 further have the following advantages. Inner walls S of the valve receiving chambers 1a and 2a are maintained in sliding contact with the respective outer surfaces 27c and 28c or rotary valves 27 and 28. This sliding contact specifically creates a seal between rotary valves 27 and 28 and the valve receiving chambers 1a and 2a. Due to the tapered shapes of the valves 27, 28 and the chambers 1a and 2a, the valves 27, 28 are complementarily and adjustingly biased to maintain an effective seal as well as to prevent excessive deterioration of the valves 27, 28 and of the chambers 1*a* and 2*a*. Even if the linear expansion coefficients of the rotary valves 27 and 28 respectively differ from those of the cylinder blocks 1 and 2, the complementary adjusting bias provided between the valves 27, 28 and chambers 1*a* and 2*a* allow for a seal to be effectively secured. Consequently, the sealing performance of the gas suction structure of the compressor will not be effected by changes in the compressor's internal temperature. Further, the rotary valves 27 and 28 may be formed of a synthetic resin, and the tapered shapes of the outer surfaces 27*c* and 28*c* of the rotary valves 27 and 28 contribute to making the compressor lighter in weight.

The drive shaft 7 has a first end portion protruding outward from the front housing 18, and a second end portion protruding into the discharge chamber 24 of the rear housing 19. A discharge passage 37 is formed in the axial center portion of the drive shaft 7. The discharge passage 37 is open to the discharge chamber 24. Connecting ports 38 are formed in the peripheral portion of the drive shaft 7 which is surrounded by the discharge chamber 23 of the front housing 18, and serve to connect the discharge chamber 23 to the discharge passage 37. Accordingly, the front and rear discharge chambers 23 and 24 are connected by the discharge passage 37, so that the refrigerant gas in the discharge chamber 24 flows into the discharge chamber 23 from the discharge passage 37. The refrigerant gas from the discharge chamber 23 is discharged via the outlet port 25 to the external refrigerant gas outlet pipe.

In the case of the flapper type suction valves, a lubricating oil increases the absorbing force between the suction valves and the contacting surfaces. Thus, the timing for the initial opening of the suction valves is delayed by the absorbing force. This delay or the elastic resistance of the suction valves reduces the volumetric efficiency. The use of the rotary valves 27 and 28 which are forcibly rotated, however, will not give rise to the problems caused by the absorbing force of the lubricating-oil or by the delay produced by the elastic resistance of the suction valves. According to the present invention, if the pressure in the compression chamber R, Ra or Rb becomes even slightly less than the suction pressure in the crank chamber 11, the refrigerant gas will spontaneously flow into the compression chamber R, Ra or Rb. The use of the rotary valves 27 and 28, therefore, significantly improves the volumetric efficiency as compared with the use of the flapper type suction valves.

The action of the piston type compressor having the above-described structure will be discussed below.

In the situation shown in FIG. 2, the double-headed piston 15 at the topmost position is at the top dead center with respect to the cylinder bore 13, and is at the bottom dead center with respect to the other cylinder bore 14. Under this situation, the outlet 29*b* of the rotary valve 27 is positioned ever so slightly apart from the suction port 1*b* that communicates with the compression chamber Ra. Likewise, the outlet 30*b* of the rotary valve 28 is positioned just an instant away from completing the communication with the suction passage 2*b* of the cylinder bore 14.

When the double-headed piston 15 enters the suction stroke to move toward the bottom dead center from the top dead center in the cylinder bore 13, the suction passage 29 communicates with the compression chamber Ra of the cylinder bore 13. Therefore, the refrigerant gas in the crank chamber 11 is sucked into the compression chamber Ra via the suction passage 29 and the suction port 1*b*.

When the double-headed piston 15 enters the compression stroke to move toward the top dead center from the bottom dead center in the cylinder bore 14, the communication of the suction passage 30 with the compression chamber Rb is blocked. Therefore, the refrigerant gas in the compression chamber Rb is discharged into the discharge chamber 24 from the discharge port 4*c* while pushing the discharge valve 32 back.

This suction and discharge of the refrigerant gas is similarly performed for the compression chambers R of other cylinder bores 13 and 14.

Figure 5:
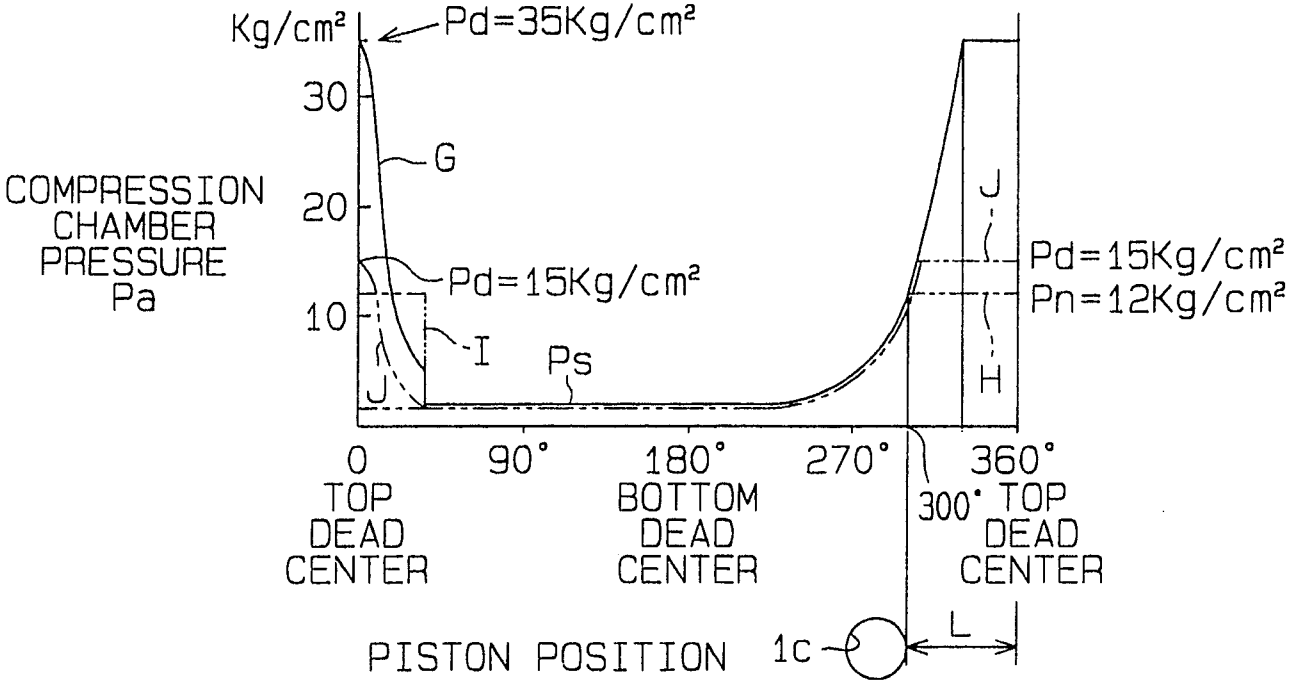
FIG. 5 is a chart showing the relation between the rotational angle of the rotary valve and the position of a piston.

FIG. 5 shows the relation between the rotatoinal angle of the drive shaft 7 or the position of the piston 15 and the pressure Pa in the compression chamber Ra. Referring to the graphs, a description will be given for when the cooling load is large and where the cooling load is small.

In the case where the cooling load is large and the discharge pressure Pd of the compressor is high (e.g., 35 $Kg/cm^2$), when the piston 15 moves toward the bottom dead center from the top dead center, the compressed gas remaining in the top compression chamber Ra is expanded again. As a result, the pressure Pa (35 $Kg/cm^2$) in the compression chamber Ra rapidly drops as indicated by a solid line G in FIG. 5. When the rotary valve 27 rotates about 40 degrees, the outlet 1*c* of the suction port 1*b*, previosuly held closed by the outer surface 15*a* of the piston 15, opens. Consequently, the compression chamber Ra and the crank chamber 11 communicate with each other via the suction passage 29 and the suction port 1*b*. This allows the refrigerant gas to be forced into the compression chamber Ra from the crank chamber 11, so that the pressure Pa in the compression chamber Ra effectively equals that of the suction pressure (e.g., 2 $Kg/cm^2$ When the piston 15 moves again toward the top dead center after having reached the bottom dead center, the suction port 1*b* is closed by the outer surface 27*c* of the rotary valve 27, compressing the refrigerant gas drawn in the compression chamber Ra and raising the pressure Pa in the compression chamber Ra. Following this, when the piston 15 reciprocates between the bottom dead center and the top dead center (about 300 degrees by the rotational angle of the drive shaft 7), the suction port 1*b* is closed by the outer surface 15*a* of the piston 15 so that a sealed space is formed inside the suction port 1*b* by both surfaces 27*c* and 15*a*. As a result, the pressure Pn in the suction port 1*b* is held at the intermediate pressure (e.g., 12 $Kg/cm^2$) as indicated by a chain line H in FIG. 5. Gas at an intermediate pressure Pn, inside the suction port 1*b*, will remain sealed until the suction port 1*b* ports a suction pressure again as indicated by a chain line I in FIG. 5.

When the pressure Pa in the compression chamber Ra rises to about the level of the discharge pressure Pd at a time when piston 15 moves toward the top dead center, the discharge valve 31 will be forced back to discharge the compressed refrigerant gas into the discharge chamber 23. Even if the pressure Pa in the compression chamber Pa continues to rise, this high pressure will not effect the outer surface 27*c* of the rotary valve 27.

When the cooling load is small and the discharge pressure Pd of the compressor is likewise low (e.g., 15 $Kg/cm^2$), pressure Pa in the compression chamber Ra varies according to the reciprocal movement of the piston 15, as illustrated by a chain line J in FIG. 5. In such a case, the pressure Pn in the suction port 1*b*, sealed by both surfaces 27*c* and 15*a*, is kept at the intermediate pressure (e.g., 12 Kg/cm$^2$) as is the case under a large cooling load condition.

Therefore, the sealed pressure acting on the outer surface 27*c* of the rotary valve 27 equalizes to an intermediate pressure Pn in the suction port 1*b*, regardless of the amount of the cooling load. Accordingly, the force of resilient member or spring 35 need not be preset to a large value, since the pressure effectively separating rotary value 27 from the inner wall S of the valve receiving chamber 1*a*, is itself a relatively small value. By setting the urging force of the resilient member or spring on the rotary valve 27 low, the rotary friction between the outer surface 27*c* of the rotary valve 27 and the inner wall S of the valve receiving chamber 1*a* is greatly reduced. This in turn, effects a reduction in the power needed to drive the compressor. The rotary value construction of the present embodiment further makes it possible to suppress the wear or rubbing of the sliding surface 27*c* of the rotary valve 27. This contributes to the overall durability of the compressor.

The timing for closing the suction port 1*b* by the piston 15 is not limited to the aforementioned rotational angle of 300 degrees so long as the pressure in the sealed suction port 1*b* is kept at an intermediate pressure Pn lower than the maximum discharge pressure Pd (35 Kg/cm$^2$).

This invention is not limited to the above-described embodiment, but may be modified in the following manner.

While this invention is embodied in a swash plate type double-headed piston type compressor in this embodiment, this invention may be embodied in a rocking swash plate type variable displacement piston compressor.

What is claimed is:

1. A refrigerant gas suction valve mechanism for a reciprocating piston type refrigerant gas compressor having a body, a drive shaft disposed rotatably in said gas receiving chamber where uncompressed gas is introduced, with a plurality of cylinder bores formed aroung a rotary shaft and extending in an axial direction, a plurality of double-headed pistons retained slidably in an axial direction in said cylinder bores, said pistons being reciprocable between a top dead center and a bottom dead center in accordance with rotation of said drive shaft, thereby defining compression chambers for compressing gas, said compressor comprising:

rotary valve means provided rotatably together with said drive shaft and having an outer wall and two end portions, said rotary valve having a suction passage to lead uncompressed gas to each of said compression chambers from said gas receiving chamber in synchronism with reciprocal motion of said pistons during rotation of said rotary valve means;

means for forming a recessed chamber in said body for rotatably receiving said rotary valve means, said recessed chamber having an inner wall extending in a circumferential direction around said rotational axis of said drive shaft and slidably engaged with said outer wall of said rotary valve means, and having a suction port for selectively permitting or blocking communication between said suction passage and said compression chambers;

urging means for urging the rotary valve against said inner wall of said recessed chamber with predetermined force in order to cause said outer wall of said rotary valve means to contact in air-tight fashion with said inner wall of said recessed chamber; and pressure setting means for setting pressure acting on an outer surface of said rotary valve means via said suction port from said compression chambers lower than a predetermined pressure.

2. The refrigerant gas suction valve mechanism according to claim 1, which further comprises a swash plate mounted on said shaft in said gas receiving chamber, and wherein said urging means is a compression spring disposed on the rotary shaft between the rotary valve means and said swash plate.

3. The refrigerant gas suction valve mechanism according to claim 2, wherein gas is sucked when said pistons move from said top dead center to said bottom dead center, and gas is compressed when said pistons move from said bottom dead center to said top dead center.

4. The refrigerant gas suction valve mechanism according to claim 3, whereim said suction port is closed by outer walls of said pistons to block communication between said suction passage and said compression chambers.

5. The refrigerant gas suction valve mechanism according to claim 4, wherein said pressure setting means includes a predetermined distance set between the suction port and a point where said pistons reach the top dead center so that the suction port is closed by the pistons before the pistons reach the top dead center.

6. A refrigerant gas suction valve mechanism for a reciprocating piston type refrigerant gas compressor having a body, a drive shaft disposed rotatably in said gas receiving chamber where uncompressed gas is introduced, with a plurality of cylinder bores formed around said rotary shaft and extending in an axial direction, a plurality of double-headed pistons retained slidably in an axial direction in said cylinder bores, said pistons being reciprocable between a top dead center and a bottom dead center in accordance with rotation of said drive shaft, thereby defining compression chambers for compressing gas, said compressor comprising:

a rotary valve provided rotatably together with said drive shaft and having an outer wall and two end portions, said rotary valve having a suction passage to lead uncompressed gas to each of said compression chambers from the gas receiving chamber in synchronism with reciprocal motion of the pistons during rotation of said rotary valve;

a recessed chamber disposed in said body for rotatably receiving said rotary valve, said recessed chamber having an inner wall extending in a circumferential direction around said rotational axis of said drive shaft and slidably engaged with said outer wall of said rotary valve, and having a suction port for selectively permitting or blocking communication between said suction passage and said compression chambers;

a compression spring disposed on the rotary shaft between the rotary valve and a swash plate mounted on said shaft for urging the rotary valve against said inner wall of said recessed chamber with predetermined force in order to cause said outer wall of said rotary valve means to contact in air-tight fashion with said inner wall of said recessed chamber; and pressure setting means for setting pressure acting on an outer surface of said rotary valve via said suction port from said compression chambers lower than predetermined pressure.

7. The refrigerant gas suction valve mechanism according to claim 6, wherein gas is sucked when said pistons move from said top dead center to said bottom dead center, and gas is compressed when said pistons move from said bottom dead center to said top dead center.

8. The refrigerant gas suction valve mechanism according to claim 7, wherein said suction port is closed by outer walls of said pistons to block communication between said suction passage and said compression chambers.

9. The refrigerant gas suction valve mechanism according to cliam 8, wherein said pressure setting means includes a predetermined distance set between the suction port and a point where said pistons reach the top dead center so that the suction port is closed by the pistons before the pistons reach the top dead center.

10. A refrigerant gas suction valve mechanism for a reciprocating piston type refrigerant gas compressor having a body, a drive shaft disposed rotatably in a gas receiving chamber where uncompressed gas is introduced, with a plurality of cylinder bores formed around said rotary shaft and extending in an axial direction, a plurality of double-headed pistons retained slidably in an axial direction in said cylinder bores, said pistons being reciprocable between a top dead center and a bottom dead center in accordance with rotation of said drive shaft, thereby defining compression chambers for compressing gas, and thereby gas is sucked when said pistons move from said top dead center to said bottom dead center, and gas is compressed when said pistons move from said bottom dead center to said top dead center, said compressor comprising:

a rotary valve provided rotatably together with said drive shaft and having an outer wall and two end portions, said rotary valve having a suction passage to lead uncompressed gas to each of said compression chambers from the gas receiving chamber in synchronism wit reciprocal motion of the pistons during rotation of said rotary valve;

a recessed chamber disposed in said body for rotatably receiving said rotary valve, said recessed chamber having an inner wall extending in a circumferential direction around said rotational axis of said drive shaft and slidably engaged with said outer wall of said rotary valve, and having a suction port for selectively permitting or blocking communication between said suction passage and said compression chambers;

a compression spring disposed on the rotary shaft between the rotary valve and a swash plate mounted on said shaft, for urging the rotary valve agains said inner wall of said recessed chamber with predetermined force in order to cause said outer wall of said rotary valve means to contact in air-tight fashion with said inner wall of said recessed chamber; and said suction port being formed at a predetermined distance from a point where said pistons reach the top dead center so that the suction port is closed by the pistons before the pistons reach the top dead center.

* * * * *

UNITED STATES PATENT AND TRADEMARK OFFICE

CERTIFICATE OF CORRECTION

PATENT NO. : 5,375,981

DATED : December 27, 1994

INVENTOR(S) : T. Fujii et al

It is certified that error appears in the above-indentified patent and that said Letters Patent is hereby corrected as shown below:

Title Page:

Under listing [63] line 6, "5,368,540" should read --5,368,450--; line 7, "101,188" should read --101,178--.

Column 1, line 5, "Sr." should read --Ser.--

Column 2, line 3, "volumetrio" should read --volumetric--;

Column 3, line 33, "the" should start new sentence i.e., "The".

Column 4, line 36, "clearnace" should read --clearance--.

Column 6, line 31, "previosuly" should read --previously--; line 63, "Pa" should read --Ra--.

Column 7, line 45 "aroung a" should read --around said--; line 52, before "rotary" insert --a--.

UNITED STATES PATENT AND TRADEMARK OFFICE

CERTIFICATE OF CORRECTION

PATENT NO. : 5,375,981

DATED : December 27, 1994

INVENTOR(S) : T. Fujii et al

It is certified that error appears in the above-indentified patent and that said Letters Patent is hereby corrected as shown below:

Column 8, line 35, "said" should read --a--; line 63, after "shaft" insert comma --,--.

Column 9, line 4, after "than" insert --a--.

Column 10, line 24, "agains" should read --against--.

Signed and Sealed this

Twentieth Day of June, 1995

Bruce Lehman

*Attest:*

BRUCE LEHMAN

*Attesting Officer*

*Commissioner of Patents and Trademarks*